United States Patent [19]

Ellmer

[11] 4,153,199

[45] May 8, 1979

[54] FIREPLACE HEATING SYSTEM

[75] Inventor: David Ellmer, South Haven, Mich.

[73] Assignee: John Hoover, Covert, Mich.

[21] Appl. No.: 767,497

[22] Filed: Feb. 10, 1977

[51] Int. Cl.[2] ..... F24B 9/04

[52] U.S. Cl. ..... 236/9 A; 237/53; 237/8 R; 126/101; 126/132

[58] Field of Search ..... 126/132, 164, 165, 101; 237/51, 53, 8 R, 16; 236/9 A

[56] References Cited

U.S. PATENT DOCUMENTS

| | | | |
|---|---|---|---|
| 4,019,677 | 4/1977 | Dotschkal et al. | 126/132 |
| 4,025,043 | 5/1977 | Cleer, Jr. | 237/53 |
| 4,049,194 | 9/1977 | Tice et al. | 237/1 A |

*Primary Examiner*—John J. Camby
*Assistant Examiner*—Larry I. Schwartz
*Attorney, Agent, or Firm*—Basile and Weintraub

[57] ABSTRACT

A closed heating system for a building particularly adapted to be installed in a conventional fireplace for supplementing the heat generated by a conventional forced air heating unit. The heating system includes a grate having a log supporting water conduit through which water passes and is heated by the logs supported thereby. The heated water is pumped through suitable valves to a heat exchanger disposed within the air duct of a conventional forced air heating system to heat the air passing therethrough. The heated water may bypass the air duct heat exchanger. The bypassed water is communicated to a coil associated with a tempering tank which is installed in the building cold water supply line that feeds the hot water heater. The hot water preheats the water supply and is then returned to a storage tank for recycling.

4 Claims, 2 Drawing Figures

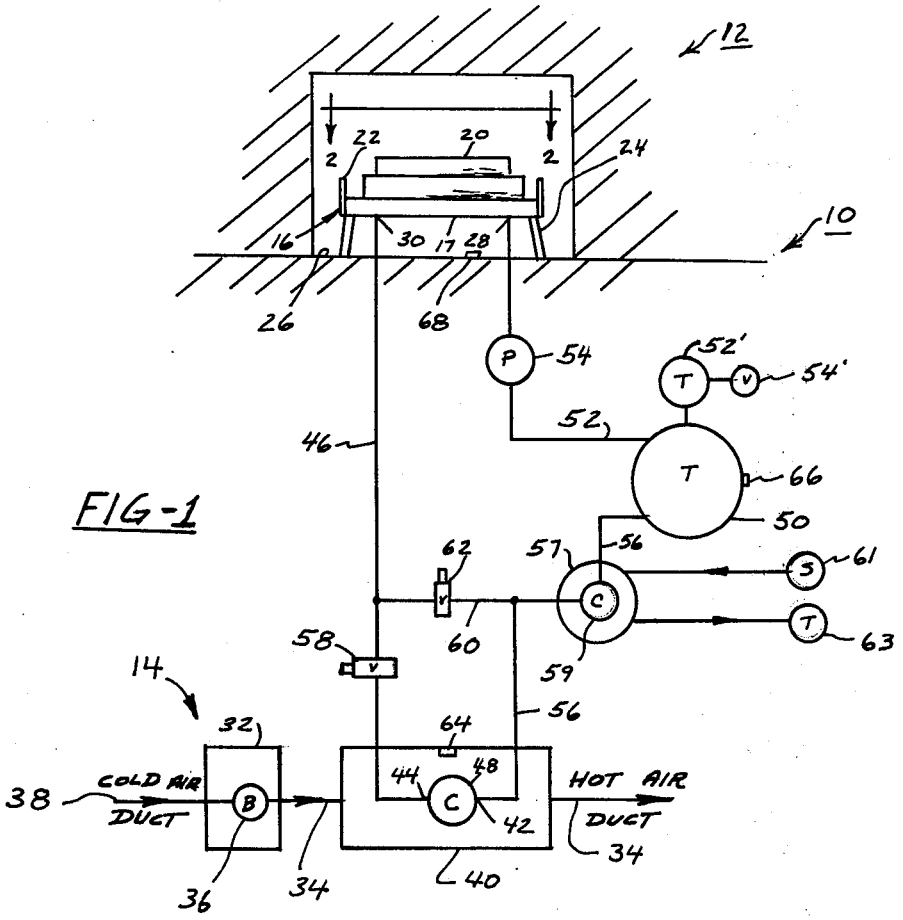
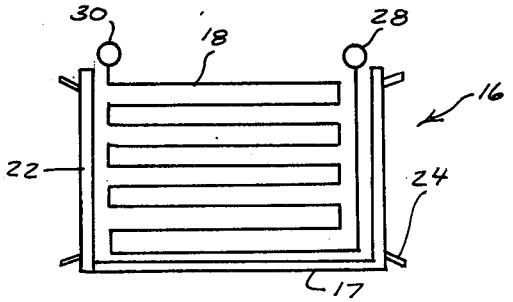
FIG-2

FIREPLACE HEATING SYSTEM

BACKGROUND OF THE INVENTION

I. Field of the Invention

The present invention is generally concerned with heat energy conservation and, more particularly, relates to a unique heating system construction utilized in conjunction with a conventional fireplace for the conservation and maximum utilization of the heat generated within the fireplace to supplement the heat generated in a conventional forced hot air heating unit.

II. Description of the Prior Art

Heretofore various attempts have been conducted in order to provide heating units which have particular application for use in conventional fireplaces for the specific purpose of providing supplemental heat to a building. The prior art, to the knowledge of the inventor, is exemplified by the following patents: U.S. Pat. Nos. 1,152,912; 2,048,675; 2,307,600; 2,453,954; and 3,945,369. These patents generally consist of two types of heat utilization systems. The first type generally employs a blower which conducts air through suitable conduits located within the fireplace such that the air is heated. The air is then piped directly within the room where the fireplace is located, or the air is piped throughout the building through suitable conduits. In this construction the unit functions as a primary source of heating for controlling the environment within the building.

A second type of fireplace heating system suggests the concept of piping hot water through the fireplace wherein the water is heated. The heated water then provides the primary source of heat for the building. This is accomplished by pumping the hot water to various conventional hot water radiators and obtaining heat therefrom in the conventional manner. While such fireplace heating systems appear to function in an acceptable manner, it is believed that applicant's invention constitutes a significant improvement over such known fireplace heating systems.

SUMMARY OF THE INVENTION

The present invention, which will be described subsequently in greater detail, comprises a heating system adapted to be installed in an open fireplace for supplementing the heat generated by a conventional forced hot air heating unit. The system comprises a grate having a log supporting base which is comprised of a tortuous shaped water carrying conduit which receives water from a water storage tank. The water is heated by logs burning on the grate, and the hot water is carried to a heat exchanger disposed within the hot air duct of the conventional forced air system to provide supplemental heating of the air passing therethrough. The heated water is returned to the storage tank or may be utilized to preheat the cold water supply before it enters the hot water tank.

It is therefore an object of the present invention to provide a fireplace heating system which may be easily installed in any conventional fireplace and which is economical in that it is designed to absorb heat energy usually wasted in such fireplaces. The absorbed heat energy may therefore by used to heat additional rooms within the building, as well as to provide a supplemental source of heat for maintaining and heating the hot water supply of the building.

Other objects, advantages and applications of the present invention will become apparent to those skilled in the art of fireplace heating systems when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 1 is a schematic representation of a fireplace heating system constructed in accordance with the principles of the present invention; and FIG. 2 is a schematic top plan view of the heating grate as seen from Line 2—2 of FIG. 1 with the logs removed for clarity.

DESCRIPTION OF THE PREFERRED EMBODIMENT

Referring now to the drawing and, in particular, to FIG. 1 wherein there is illustrated one example of the present invention in the form of a heating system 10 adapted to be installed in an open fireplace 12 for supplementing the heat generated by a conventional forced hot air heating system 14. The heating system 10 comprises a grate 16 (see FIG. 2). The grate 16 comprises a log supporting base 17 which is preferably fabricated from a metal water carrying conduit 18 that is shaped to follow a tortuous path and of suitable size and strength to support the logs 20, which are desired to be burned. The grate 16 is provided with metal supporting side walls 22 and legs 24 such that the base 17 may be elevated above the floor 26 of the fireplace 12 in the conventional manner. The water carrying conduit 18 has an inlet 28 and an outlet 30 such that water may be pumped, as will be described hereinafter, into the inlet 28 of the conduit 18 and follow a tortuous path wherein the burning logs 20 heat the water to a desired temperature and the hot water is exhausted through the outlet 30, for a purpose to be described hereinafter.

As can best be seen in FIG. 1, the conventional forced hot air heating system 14 comprises a furnace 32 which includes a suitable heating means (not shown), such as gas or oil furnace burners, for heating air which is propelled or otherwise forced through the furnace 32 into a hot air duct 34 by means of a blower 36 that is carried within the furnace 32. As is conventional with such systems, the building which is being heated includes a cold air return duct 38. Thus, in the conventional system air is heated by the furnace 32 by means of the oil or gas burners and is forced by means of the blower 36 into the hot air ducts 34. The air which is heated is then distributed throughout the house through conventional grates disposed in selected locations within the building. Cold air returns are strategically located within the building, and the air within the building is drawn into the cold air returns and is communicated to the furnace 32 via the cold air return ducts 38 for reheating and recycling. Conventional systems include a thermostat (not shown) within the building which functions to activate the furnace 32 when the temperature within the building drops below a predetermined level.

In applicant's invention the hot air duct 34 is modified to incorporate a heat exchanger 40. The heat exchanger 40 includes a coil 42 which, as will be described hereinafter, has an inlet 44 that receives hot water from the outlet 30 of the grate water carrying conduit 18. The connection may be made by an insulated feed line 46. The coil 42 has an outlet 48 which carries water from the heat exchanger 40. Air passing through the conventional hot air duct 34 under the force of the blower 36 will pass by the hot coil 42, and the air within the duct 34 will be heated.

The heating system 10 further comprises a storage tank 50 which includes an expansion tank 52' and a pressure relief valve 54', both of which function in a conventional manner to provide for proper expansion and pressure limitations for the system 10. Water stored in the storage tank 50 is communicated via insulated conduit 52 and pump 54 to the inlet 28 of the grate water carrying conduit 18. The outlet 48 of the heat exchanger 40 communicates with the storage tank through return line 56 and a tempering tank 57.

The feed line 46 is provided with a solenoid operated on-off valve 58, which in response to temperature within the heat exchanger 40 may be switched on or off to either open or close communication from the feed line 46 to the coil 42. Heating system 10 further comprises a bypass line 60 which includes a solenoid operated on-off valve 62. The heat exchanger 40 has a thermostat 64 which is designed to operate in response to a predetermined temperature level within the heat exchanger 40. When the temperature reaches a predetermined level, the on-off valve 58 is activated to close; and the on-off valve 62 is actuated to its on position, such that hot water will bypass the heat exchanger 40 and be communicated directly to the tempering tank 57.

The tempering tank 57 has a coil or heat exchanger 59 which functions to preheat the water communicated from the cold water supply 61 to the building's hot water tank 63. The coil 59 may be disposed within a separate tempering tank, or the coil may be wrapped around the tempering tank which is installed in the cold water supply line that feeds the hot water tank 63. In this manner the water supply is preheated before it enters the hot water heater 63, thus saving fuel. After passing through the coil 59 in the tempering tank 57, the water is returned to the fireplace storage tank 50 where the water is stored or recycled through the system 10. By using a closed heating system, a permanent antifreeze solution may be used in the system, thus raising the boiling temperature of the water while lubricating the circulating pump 54.

In normal operation water drawn from the tank 50 by means of pump 54 is communicated to the fireplace grate 16 and is heated in the manner aforementioned. Hot water passes through the outlet 30 of the grate 16 and flows through feed line 46 into the coil 42 wherein the air passing through the hot air duct 34 is heated by the hot water. Hot water is then returned to the storage tank 50 via the tempering tank 57 by means of return line 56. This circulation of hot water will continue until the temperature in the air duct 34 rises to a predetermined level, usually associated with the discontinued operation of the blower 36, necessitated by the rising of the air within the building to a predetermined level. At this point the on-off valve 58 is actuated in response to the temperatue rise to an off position, and water is diverted or bypassed through on-off valve 62 to the tempering tank 57. The pump 54 may also be deactivated; however, a separate thermostat 66 associated with the storage tank may be utilized to maintain the pump in an operative mode so that hot water continues to flow into the storage tank. This may be for the purpose of always providing hot water in the storage tank while a fire is available within the fireplace 12. This may be a desirable use of the system when the tempering tank 57 is also utilized as the source of hot water for the building within which the same is located.

A suitable heat sensor 68 in the fireplace 12 is operable to deactivate the pump 54 when the fireplace 12 is not in use. This will preserve the hot water in the tank 50.

It can thus be seen that applicant has provided a new and improved heating system for use in conjunction with a conventional fireplace for providing a supplemental heat source for use in conjunction with conventional forced hot air heating systems.

While only one example of applicant's invention has been disclosed, it should be understood by those skilled in the art of heating systems for fireplaces that other forms of applicant's invention may be had, all coming within the spirit of the invention and the scope of the appended claims.

What is claimed is as follows:

1. A heating system adapted to be installed in an open fireplace for supplementing the heat generated by a conventional forced hot air heat system, said heating system comprising:
   - a conventional forced hot air heat system having a hot air duct;
   - a grate having a log supporting base, said base comprising a water carrying conduit following a tortuous path in which water is heated by the burning logs supported by said base, said water carrying conduit having an inlet through which water is introduced and an outlet through which hot water is exhausted;
   - a hot water storage tank communicating with said base inlet;
   - a heat exchanger mounted in said hot air duct of said conventional forced hot air heat system, said heat exchanger having an inlet connected to said grate outlet and an outlet connected to said storage tank;
   - pump means for pumping said water from said storage tank through said grate base and to said heat exchanger; and
   - temperature sensing means in said duct, said temperature sensing means responsive to a predetermined temperature within said air duct for actuating said pumping means.

2. The heating system defined in claim 1 further comprising:
   - a bypass line communicating said grate outlet to said storage tank for bypassing said heat exchanger;
   - first valve means associated with said feed line for closing communication between said feed line and said heat exchanger; and
   - second valve means associated with said bypass valve for opening communication between said grate outlet and said storage tank, said valves being operable in response to said temperature sensing means.

3. The heating system defined in claim 1 wherein the outlet of said grate and the inlet of said coil are connected by means of an insulated conduit.

4. The heating system defined in claim 2 further comprising a tempering tank disposed in the water supply of a hot water tank for preheating the water prior to its entry into said water tank;
   - means associated with said tempering tank for heating the water therein; and
   - temperature sensing means associated with said tempering tank operating said pump when said first valve means is closed and said second valve means is open and water from said grate outlet bypasses said heat exchanger.

* * * * *